US010286620B2

(12) United States Patent
Poth et al.

(10) Patent No.: US 10,286,620 B2
(45) Date of Patent: May 14, 2019

(54) RADIAL PRESS

(71) Applicant: UNIFLEX HYDRAULIK GmbH, Karben (DE)

(72) Inventors: Hubert Poth, Nidderau (DE); Harald Von Waitz, Kahl am Main (DE); Carsten Baumgartner, Laubach (DE)

(73) Assignee: Uniflex Hydraulik GmbH, Karben (DE)

( * ) Notice: Subject to any disclaimer, the term of this patent is extended or adjusted under 35 U.S.C. 154(b) by 144 days.

(21) Appl. No.: 15/370,473

(22) Filed: Dec. 6, 2016

(65) Prior Publication Data

US 2017/0080659 A1 Mar. 23, 2017

Related U.S. Application Data

(63) Continuation of application No. PCT/EP2015/000828, filed on Apr. 21, 2015.

(30) Foreign Application Priority Data

Jun. 6, 2014 (DE) ..... 10 2014 008 613

(51) Int. Cl.
*B30B 7/04* (2006.01)
*B21D 39/04* (2006.01)
(Continued)

(52) U.S. Cl.
CPC ..... *B30B 7/04* (2013.01); *B21D 39/048* (2013.01); *B25B 27/10* (2013.01); *B30B 15/16* (2013.01)

(58) Field of Classification Search
CPC ..... H01R 43/0486; B30B 7/04; B30B 15/16; B30B 15/0094; B30B 9/207; B30B 9/205; B21D 39/048
(Continued)

(56) References Cited

U.S. PATENT DOCUMENTS 4,306,442 A 12/1981 Schröck
4,578,982 A 4/1986 Schröck
(Continued)

FOREIGN PATENT DOCUMENTS

DE 28 44 475 A1 4/1980
DE 33 31 721 A1 3/1985
(Continued)

OTHER PUBLICATIONS

International Search Report issued for corresponding International Patent Application No. PCT/EP2015/000828 dated Jun. 30, 2015.

*Primary Examiner* — Shelley M Self
*Assistant Examiner* — Christopher B Wehrly
(74) *Attorney, Agent, or Firm* — Myers Wolin, LLC

(57) ABSTRACT

A radial press is provided, the radial press having a frame structure, a pressing tool, a drive unit, and a press control. The pressing tool comprises a plurality of pressing elements which are disposed uniformly concentrically around a press axis and have pressing surfaces. During the appropriate activation of the drive unit, the pressing elements can be moved synchronously as required towards or away from the press axis. To this end, at least two measured value recorders, which are connected for signal transmission purposes to a comparator associated with the press control, are disposed on the pressing tool at positions spaced apart from one another in the direction of the press axis (A). When the comparative value, generated by the comparator, of the measured values provided by the measured value recorders exceeds a tolerance range stored in the press control, an activation of the signal output unit is triggered.

14 Claims, 2 Drawing Sheets

(51) Int. Cl.
*B25B 27/10* (2006.01)
*B30B 15/16* (2006.01)

(58) Field of Classification Search
USPC ..... 100/99; 72/402, 21.4
See application file for complete search history.

(56) References Cited

U.S. PATENT DOCUMENTS

| | | | | | |
|---|---|---|---|---|---|
| 4,766,808 | A | | 8/1988 | Schröck | |
| 4,914,602 | A | * | 4/1990 | Abe | H01R 43/0486 140/105 |
| 5,323,697 | A | * | 6/1994 | Schrock | B21D 39/048 100/232 |
| 6,067,828 | A | * | 5/2000 | Bucher | B30B 15/146 29/751 |
| 6,606,891 | B1 | * | 8/2003 | McGowan | H01B 17/325 29/715 |
| 2012/0314226 | A1 | * | 12/2012 | Kelly | H01R 43/0428 356/625 |

FOREIGN PATENT DOCUMENTS

| | | | |
|---|---|---|---|
| DE | 36 11 253 | A1 | 10/1987 |
| DE | 41 35 465 | A1 | 4/1993 |
| DE | 199 12 976 | A1 | 9/2000 |
| DE | 100 47 025 | C2 | 11/2002 |
| DE | 101 49 924 | A1 | 4/2003 |
| DE | 198 17 882 | B4 | 8/2005 |
| EP | 0 539 787 | A1 | 5/1993 |
| EP | 1 149 438 | A1 | 10/2001 |
| WO | 97/25757 | A1 | 7/1997 |
| WO | 2013/140084 | A1 | 9/2013 |

* cited by examiner

RADIAL PRESS

CROSS REFERENCE TO RELATED APPLICATIONS

This application is a continuation under 35 U.S.C. § 120 of International Application PCT/EP2015/000828, filed Apr. 21, 2015, which claims priority to German Application 10 2014 008 613.5, filed Jun. 6, 2014, the contents of each of which are incorporated by reference herein.

FIELD OF THE INVENTION

The present invention relates to a radial press having a frame structure, a pressing tool, a drive unit, and a press control, wherein the pressing tool comprises a plurality of pressing elements having pressing surfaces, which elements are disposed uniformly concentrically around a press axis, and can be moved synchronously, optionally in the direction toward the press axis or away from it, with corresponding activation of the drive unit.

BACKGROUND

Radial presses of the type indicated above can be used for various applications, for example for connecting fittings with house sections, within the scope of the production of hydraulic hose lines ready for installation. They are known in different designs and embodiments, for example as what is called a "yoke press" (cf. DE 4135465 A1, DE 19912976 A1, and DE 19817882 B4, for example), a "hollow-piston press" (cf. DE 10149924 A1, for example), or in another design (cf. DE 2844475 A1, DE 3611253 A1, DE 10047025 C2, and DE 3331721 A1, for example).

Radial presses of the stated type have proven themselves in practice. When used properly, connections between two components can be produced, for example, which have a long useful lifetime and meet very great demands (e.g. hose section and connection fitting). Regardless of this, the present device is based on the task of further improving radial presses of the type stated initially, with regard to their handling, specifically and particularly to the effect that high-quality results are dependent, even less than before, on the experience and/or extensive training of the respective operator, or, in other words, the risk of the production of low-quality results by less experienced or less well-trained operating personnel is reduced.

SUMMARY

This stated task is accomplished, according to the present device, in that in a radial press of the stated type, at least two measured value recorders, connected with a comparator that is associated with the press control, for transmitting signals, are disposed on the pressing tool at positions that are spaced apart from one another in the direction of the press axis, wherein activation of a signal output unit is triggered if a tolerance range stored in the memory of the press control is exceeded by the comparison value generated in the comparator, of the measured values made available by the measured value recorders. In other words, the radial press described is therefore characterized in that at least two measured value recorders are provided on its pressing tool, specifically in an arrangement in which they are offset from one another, in the direction of the press axis. These two measured value recorders are connected with the press control so as to transmit signals, specifically with a comparator associated with the control, in which comparator the measured values or, if applicable, measured value progressions made available by the two measured value comparators while pressing is carried out, or at least at its end, are (continuously or intermittently) compared. If the comparison value determined in this regard, which—as a function of the specific embodiment of the recorders—can consist, for example, of the difference of the measured values made available by the recorders or, alternatively, their relationship with one another, outside of a tolerance range that is stored in the memory of the press control, then a signal is output that signals to the operator that a result lies outside of the target range or that pressing is taking place outside of the plan. In this manner, different errors brought about on the operator side, in particular, which can cause pressing to take place at lower quality, can be recognized at an early point in time, and a correction can be made. This specifically holds true for incorrect positioning of the workpieces within the radial press, i.e. offset from the ideal position to a greater or lesser degree, in the direction of the press axis. In this way, embodiments of the present invention makes use of the recognition that even an offset of the workpiece that appears to be rather slight—in the direction of the press axis—relative to its ideal position leads to internal (asymmetrical or off-center) force conditions that cause a deformation of the radial press that brings with it a result of pressing that deviates from its planned form, for example in that the work piece is slightly conical instead of cylindrical at the end of pressing. Such a situation cannot be detected with conventional press controls, even if the pressing force is monitored during the pressing cycle, because the pressing force as such typically ranges within the predetermined bandwidth in this regard, but is introduced into the workpiece to a different degree over its axial expanse, because the deformation of the radial press caused by the said offset leads to a—more or less marked—slanted position of the pressing surfaces relative to the press axis.

When using the radial press provided, the ratio of the measured values made available by the two measured value recorders is shifted outside of the tolerance range stored in the memory of the press control in the case of such positioning of the workpiece within the radial press, deviating from the ideal position. This is signaled to the operator, if applicable with simultaneous automatic stopping of the pressing process. If, in this regard, such detection takes place not only or not just toward the end of the pressing process, but rather (continuously or at least intermittently) over the entire pressing process, then the latter can be stopped at such an early point in time that correction of pressing is possible, i.e. no scrap is caused in the first place. Even more, grossly incorrect operation or significant interference influences, for example the presence of foreign bodies in the region of the workpiece, processing of damaged (e.g. broken) workpieces or the like, can be detected immediately when using the device described, with workpiece breakage that occurs during the pressing process having the effect of marked inconstancy of the measured values made available by the measured value recorders, for example. Detection of incorrect operation is also highly advantageous with regard to the useful lifetime of the radial press, for example in that the pressing process is stopped immediately if there are indications, due to a corresponding comparison value, that a connection fitting to be connected with a hose was placed into the radial press all the way to the union nut or that there is a foreign body in the tool.

Even if less experienced or less well-trained personnel is used for operating the radial press, the risk of producing lower-quality workpieces with the radial pressing process is far less when using a radial press provided than when using known radial presses of the stated type, according to the state of the art.

The measured values made available by the measuring recorders can preferably also be used for individual, workpiece-related modification of the pressing progression stored in the memory of the press control. In this sense, it is possible, for example, to modify the pressing speed as a function of the measured values of the measuring recorders, and, in this manner, to optimize them specifically with regard to the individual workpiece to be pressed. Variations with regard to the dimensions and/or the material of the workpiece that lie within tolerance can be taken into consideration when carrying out the individual pressing process, in this way.

Furthermore, when using the radial press provided, a degree of effectiveness analysis is possible by way of a comparison of the forces that bring about forming of the workpiece, for which the measured values made available by the measured value recorders are an indicator—if the measured value recorders are suitably designed—with the energy consumption of the radial press. This, too, is a measure that allows optimization of the pressing process—with regard to its energy efficiency.

A further positive effect of the present invention is the possibility of saving material in the production of the workpiece (at the same performance capacity). This is because the workpiece requires less of a safety margin as the result of optimization of forming of the workpiece in the radial press provided (see above) than is required when processing corresponding workpieces on conventional radial presses—for example in order to guarantee a secure and reliable connection of a connection fitting with a hose piece.

The positive effects of the present invention are not, however, restricted to the quality of the pressed workpiece. Instead, monitoring and analysis or evaluation of the measured values made available by the measured value recorders allow drawing conclusions regarding the state of the radial press, particularly regarding wear of wear parts. This makes it possible to better coordinate the maintenance intervals and the replacement of wear parts with the individual requirements of the individual machine. In this case, precautionary early replacement of wear parts is not necessary, and this is a significant economic aspect. At the same time, reliability can also be increased; this is because by means of monitoring and analysis or evaluation of the measured values made available by the measured value recorders, it is also possible to immediately recognize damage (for example breakage of pressing elements or other parts of the pressing tool)—by way of the anomalies of the measurement values caused by it—which damage might cause consequential damage, possibly even with danger for the operating personnel. The same holds true for the recognition of fatigue of machine components, as well as possible manipulation of the radial press. In this regard, the measured values determined are preferably stored in memory for an extended period of time, archived (if applicable, compressed), and evaluated for the purpose of optimization of the processes and of quality assurance, and transmission (online or on data media) to the machine manufacturer—for a statistical evaluation relating to multiple radial presses—is also possible.

Furthermore, if the at least two measured value recorders are structured appropriately, the measured values made available by them can be used for a significantly more precise determination of the pressing force as compared with the presence of merely one pressing force sensor.

Particularly informational findings regarding the state of the radial press and of the pressed workpiece can be obtained if the measured values made available by the measured value recorders are put into relation with the process parameters that are characteristic for the pressing process, such as, for example, the pressure in a hydraulic cylinder that belongs to the drive unit, the time within a pressing cycle and/or the path of the drive for the pressing tool. Not only is it possible to determine irregular operating states, such as pressing of an incorrect workpiece, use of a wrong pressing tool, the absence of individual pressing elements or the like, to be determined by means of reconciliation of the determined values with reference values that are characteristic for the pressing process to be carried out. Even in the case of regular pressing sequences, evaluations are useful, for example in that the ideal duration of stopping the press at the end of the pressing process is determined as a function of how the measured values made available by the measured value recorders change over time. In this way it is possible, in the interests of great efficiency, i.e. the shortest possible cycle times, to shorten holding times that have been dimensioned to be long, as a precaution. In this sense, the radial press can be opened as soon as the change in the measured values over time (measured value gradient) drops below a specific value.

The progression of the measured values when opening the radial press in turn provides a direct conclusion regarding the spring-back of the workpiece. In this way, it can already be determined at an early point in time, i.e. when the radial press has not yet been opened completely, that specific follow-up pressing is still required, so that the workpiece (which springs back) will adhere to its planned dimension after the radial press is opened. Comparable conclusions regarding later spring-back of the workpiece can be drawn from those measured values that the at least two measured value recorders determined when the planned dimension of the workpiece is reached for the first time, so that the dimension of required over-pressing can already be determined, taking these measured values into account.

In the above text, it has already been mentioned that in addition to the (particularly optical and/or acoustical) signal output unit, by means of which the operator's attention is drawn to the fact that pressing is not proceeding according to plan, it can be provided that—by means of influencing the drive unit accordingly—the pressing process is automatically interrupted or stopped. It is advantageous, in this regard, if the signal output unit has a comparison value display and/or a correction value display, which allows the operator to determine the extent of possible incorrect positioning of the workpiece or of the correction required accordingly. The value for a position correction of the workpiece can be calculated in the press control itself, from the deviation of the comparison value of the two measured values made available by the measured value recorders, from the ideal value for a position correction of the workpiece stored in the memory of the press control for the pressing process in question, and, for example, a stop for the workpiece can be displaced accordingly. The same holds true for optical display of a corrected position of the workpiece, for example by means of a laser marking.

According to another preferred further embodiment, it is provided that three recorders disposed at a distance from one another in the direction of the press axis are provided. In this regard, the third measured value recorder can particularly make a reference value available, for which purpose it is ideally disposed more or less centered between the two other measured value recorders or in the plane of symmetry—that stands perpendicular on the press axis—of the radial press. Simultaneously taking the signals of all three measured value recorders into consideration makes supplemental data available, from which conclusions can be drawn, particularly with regard to workpiece-specific anomalies (for example, damage to the workpiece at certain points).

The present device can be implemented, with excellent results, also in those radial presses, which are in widespread use, the pressing elements of which are structured in multiple parts, particularly in that they—structured in two parts—have a base jaw radially on the outside and a removable pressing jaw radially on the inside, or, alternatively—structured in three parts—comprise a base, an intermediate jaw, and a removable pressing jaw that has the pressing surface. Particularly informational findings occur in this case if the measured value recorders are disposed on at least one pressing jaw, specifically preferably in the region of its two ends, which lie opposite one another in the direction of the press axis. From construction aspects and other practical aspects, on the other hand, placement of the at least two measured value recorders on at least one base jaw is particularly advantageous. It is true that the signal intensity of the signal made available by the respective measured value recorder is typically lower in this arrangement of the measured value recorders than in the case of placement of the measured value recorders on the pressing jaw—which lies directly against the workpiece—something that would tend to speak in favor of placement of the recorders on the latter; on the other hand, the signal is still sufficiently strong, if the measured value recorders disposed on a base jaw are structured properly, that reliable evaluation in the sense of the present device can take place. And the disadvantage of a lower signal intensity is more than outweighed by marked advantages with regard to the reproducibility of the measured results and also handling of the radial press during operation. The latter aspect includes that when the measured value recorder is placed on at least one base jaw, replacement of a pressing jaw, as required for refitting the radial press from one pressing task to another, is not hindered. Also, when the measured value recorders are placed on at least one base jaw, noteworthy advantages occur from a cost aspect; in this case, reliable and cost-advantageous measured value recorders using wired signal transmission can be used, and it is not necessary to outfit all the pressing jaw sets kept on hand for the different pressing tasks with measured value recorders. If, in contrast, it is desirable in an individual case, due to certain aspects, to place the measured value recorders on the pressing jaws, these recorders are particularly preferably set up for wireless signal transmission, in order to avoid the effort connected with connecting the measured value recorders with the press control, which would otherwise be necessary for every refitting of the radial press.

In the case of such radial presses (typically "yoke presses"), in which one of the base jaws is disposed fixed in place—relative to the frame structure, preferably at least two measured value recorders are disposed on specifically that base jaw. This proves to be particularly advantageous with regard to the simplest possible structure of the radial press provided, with simultaneously great reliability. In this respect, it is particularly important, as far as the signal quality is concerned, that no interference influences exist, as is the case of base jaws not fixed in place, i.e. support so as to slide on control surfaces.

Within the scope of the present disclosure, measured value recorders having different designs can be used, in order to detect the stress states discussed above, which lead to results not in accordance with the plan. Particularly advantageous results can be achieved at comparatively low costs, using measured value recorders that are structured as deformation recorders. Here, strain gauges should be specifically mentioned as particularly preferred embodiments. Signals that can be excellently evaluated are made available, in this regard, by full-bridge strain gauges, which can particularly be affixed to the pressing elements (particularly the base jaws) on the face side. Instead of indirect determination of the stress states by way of the deformation caused by them, as detected by deformation recorders such as strain gauges, however, the stress states (for example in the at least one base jaw) can also be detected directly—using corresponding measured value recorders.

The sampling rates of the measured value recorders are based on the workpiece to be pressed. While sampling rates preferably lie in the range between 5 ms and 10 ms (corresponding to a frequency between 100 Hz and 200 Hz) for typical applications (for example pressing of a connection fitting to a hydraulic hose), sampling rates are preferably lower for sensitive applications of the radial press provided (for example when pressing of or on ceramic components such as insulators), for example in the range between 1 ms and 10 ms (corresponding to a frequency between 100 Hz and 1 kHz), or even lower.

The tolerance range stored in the memory of the press control, which is used in the evaluation of the measured values made available by the measured value recorders, can particularly preferably be adjusted by means of an input unit. This takes into consideration the circumstance that different relationships of the measured values made available by the individual measured value recorders, relative to one another, can prove to be ideal, advantageous or tolerable for different pressing tasks. In particular, the relationship that the measured values made available by the measured value transducers ideally have with one another depends on what the ideal position of the workpiece is within the pressing tool.

Alternatively or additively, the press control can particularly also comprise an adaptation circuit for the tolerance range, which takes the geometrical location of the pressing surfaces relative to the position of the recorders into consideration as an input signal. In this further embodiment it is taken into consideration that (in the case of multi-part pressing elements) the axial length of the pressing jaws—particularly those for low workpiece diameters—is often substantially less than the axial length of the base jaws on which the measured value recorders are ideally affixed on the end side (see above). In this regard, the pressing jaws are typically not affixed so that they are positioned centered on the base jaws, but rather in such a manner that pressing jaws and base jaws end flush on the side facing the operator. This in turn brings with it the result that the pressing surfaces typically lie offset with reference to the center of the base jaws. The greater the offset, the more markedly the measured values made available by the measured value recorders differ in the case of an ideal progression of pressing.

It was possible to determine that already in the case of using two measured value recorders, particularly assigned to a single pressing element, very good results (particularly in the sense of great reproducibility) can be achieved. However, this does not preclude providing recorder arrangements having at least two measured value recorders, in each instance, in the interests of redundancy or of the possibility of additional plausibility checks, distributed over the circumference (particularly on multiple pressing elements), where average value formation of the measured values of those recorders that are disposed on the side of the radial press that faces the operator, on the one hand, and the measured values of those recorders that are disposed on the side of the radial press that faces away from the operator, on the other hand, can take place in the press control. A comparison of the one and of the other average value with one another then takes place within the comparator, in order to determine a possible stress situation not in accordance with the plan, in the sense of the explanations provided above.

The radial press provided can furthermore have a temperature sensor, in accordance with yet another preferred further development, the signal of which sensor is passed to the machine control. In this way, temperature-related influences, such as, for example, the lubrication behavior of lubricants, which is dependent on the operating temperature, can be taken into consideration and compensated. In this sense, multiple temperature-dependent characteristic fields regarding the ideal comparison value of the measured values and the permissible tolerance are stored in the memory of the machine control, preferably for every predetermined pressing process. In this way, even better workpiece quality can be achieved.

BRIEF DESCRIPTION OF THE DRAWINGS

In the following, the present invention will be explained in greater detail using a preferred exemplary embodiment, structured as a yoke press, shown in the drawing, which is based on a design of the radial press essentially corresponding to DE 4135465 A1 (to the extent that reference is made to it). In this regard, the figures show.

DETAILED DESCRIPTION OF THE PREFERRED EMBODIMENTS

The radial press on which the present exemplary embodiment is based corresponds, to a great extent, to the design described and explained in DE 4135465 A1, as it is furthermore also widespread in practice. To avoid repetition, reference is therefore made to the said publication, to its full extent.

Figure 1:
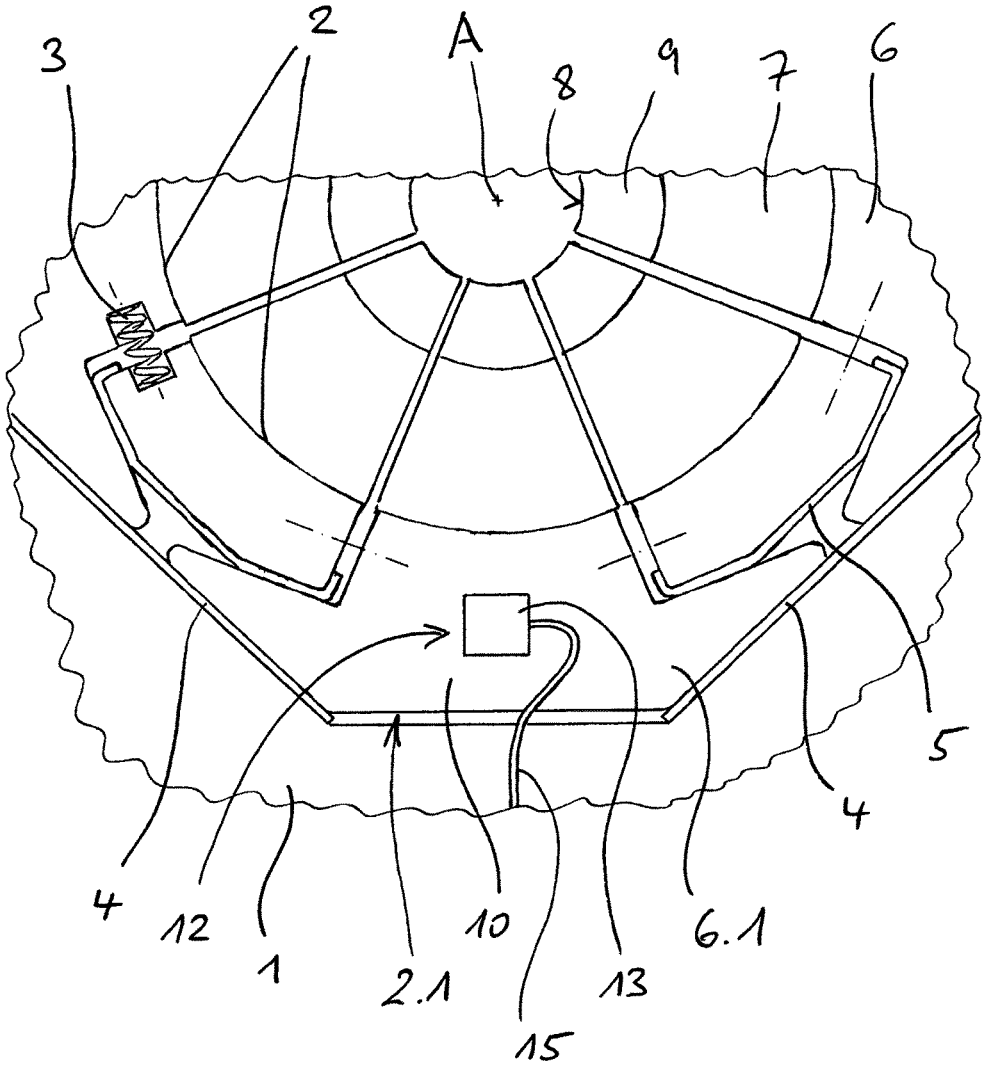
FIG. 1—a detail, in a top view, of the face side of the pressing tool of the radial press, which faces the operator, with the equipment according to the invention, and FIG. 2—a detail, in a perspective view, of the face side of the pressing tool of the radial press, which faces away from the operator.
Figure 2:
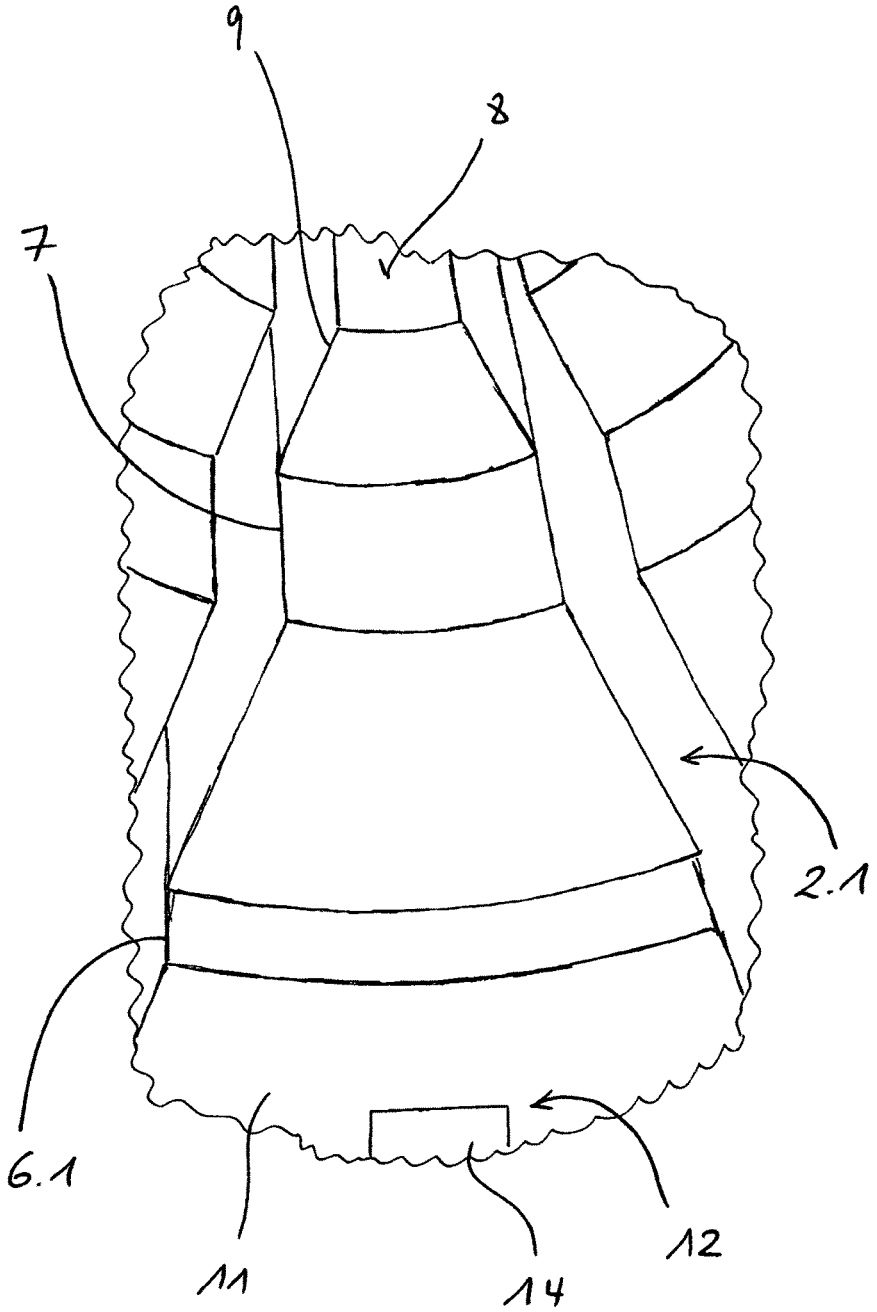

In the detail of the front-side top view of the pressing tool shown in FIG. 1, the lower yoke 1 (fixed in place), five pressing elements 2, the springs 3 disposed between the pressing elements, the two slide panels 4 that are laid into the lower yoke 1, as well as the slide panels 5 affixed to the "45° pressing elements" can be seen arranged about a press axis (A). Differently from what is illustrated in DE 4135465 A1, according to FIG. 1 the lower pressing element 2.1, disposed fixed in place relative to the lower yoke 1, does not touch the lower yoke directly, but rather supports itself exclusively on the slide panels 4. And furthermore, FIGS. 1 and 2 illustrate the three-part structure of the pressing elements 2, in each instance, composed of a base jaw 6, an intermediate jaw 7 that is removably affixed to the base jaw, and a pressing jaw 9 that has the pressing surface 8 and is removably affixed to the intermediate jaw, as is typical when using pressing elements having a great radial expanse for pressing tasks having a comparatively small diameter. If the radial press is refitted for processing workpieces having a comparatively large diameter, then pressing jaws 9 are used that are mounted directly on the base jaws 6, so that in this case, the pressing elements 2 have two parts FIG. 2 shows a typical situation of the individual parts of three-part pressing elements 2 relative to one another, as far as the axial expanse is concerned. Specifically, the intermediate jaw 7 is clearly shorter than the base jaw 6, and the pressing jaw 9 in turn is clearly shorter than the intermediate jaw 7. In this way, in a typical application, pressing jaws having a length of 70 mm on base jaws having a length of 118 mm can be used, for example, where the pressing jaws 9, the intermediate jaws 7, and the base jaws 6 end almost flush on the side facing the operator (FIG. 1).

On the lower pressing element 2.1, which is fixed in place, namely on its base jaw 6.1, measured value recorders 12 in the form of full-bridge strain gauges 13 and 14 are affixed at the end side, on the two face sides 10 and 11 that lie opposite one another. It is noted that the base jaw 6.1 of the lower pressing element 2.1 is one of several base jaws 6, each associated with a corresponding pressing element 2. These are connected with the press control, namely with a comparator assigned to it, by way of signal cables 15 so as to transmit signals.

What is claimed is:

1. A radial press comprising:

a frame structure;

a pressing tool;

a drive unit; and a press control, wherein the pressing tool comprises a plurality of pressing elements having pressing surfaces, which elements are disposed uniformly concentrically around a press axis, and can be moved synchronously in the direction toward the press axis or away from it, with corresponding activation of the drive unit, wherein at least two measured value recorders, connected with a comparator that is associated with the press control, for transmitting signals, are disposed on the pressing tool at positions that are spaced apart from one another in the direction of the press axis, wherein activation of a signal output unit is triggered if a tolerance range stored in the memory of the press control is exceeded by a comparison value generated in the comparator of the measured values made available by the measured value recorders, wherein the measured values are measured simultaneously.

2. The radial press of claim 1, wherein if the tolerance range is exceeded by the comparison value of the signals made available by the measured value recorders, the press control automatically acts on the drive unit.

3. The radial press of claim 1, wherein three measured value recorders that are spaced apart from one another in the direction of the press axis are provided.

4. The radial press of claim 1, wherein the pressing elements each comprise base jaws and removable pressing jaws that have the pressing surfaces.

5. The radial press of claim 4, wherein removable intermediate jaws are disposed, in each instance, between the base jaws and the pressing jaws.

6. The radial press of claim 4, wherein measured value recorders are disposed on at least one base jaw, in the region of its two ends that lie opposite one another in the direction of the press axis.

7. The radial press of claim 6, wherein the measured value recorders are disposed on at least two face surfaces of at least one base jaw.

8. The radial press of claim 4, wherein the measured value recorders are disposed on a base jaw that is fixed in place.

9. The radial press of claim 4, wherein measured value recorders are disposed on at least one pressing jaw, in the region of its two ends that lie opposite one another in the direction of the press axis, which recorders communicate wirelessly with the press control so as to transmit signals.

10. The radial press of claim 1, wherein the measured value recorders are structured as deformation recorders.

11. The radial press of claim 1, wherein the signal output unit comprises a comparison value display.

12. The radial press of claim 1, wherein the tolerance range can be set by means of an input unit.

13. The radial press of claim 1, wherein the press control comprises an adaptation circuit for the tolerance range, which circuit takes a geometrical location of the pressing surfaces relative to the position of the measured value recorders into consideration as the input signal.

14. The radial press of claim 1, wherein each of the at least two value recorders comprises an arrangement of multiple recorders distributed around the press axis, wherein formation of an average value for the multiple recorders of each of the at least two value recorders takes place in the press control.

* * * * *